US008382255B2

(12) United States Patent
Mardilovich et al.

(10) Patent No.: US 8,382,255 B2
(45) Date of Patent: Feb. 26, 2013

(54) THERMAL INKJET PRINTHEAD WITH HEATING ELEMENT IN RECESSED SUBSTRATE CAVITY

(75) Inventors: Peter Mardilovich, Corvallis, OR (US); Lawrence H. White, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/258,640

(22) PCT Filed: Oct. 27, 2009

(86) PCT No.: PCT/US2009/062195

§ 371 (c)(1), (2), (4) Date: Sep. 22, 2011

(87) PCT Pub. No.: WO2011/053277

PCT Pub. Date: May 5, 2011

(65) Prior Publication Data

US 2012/0013685 A1 Jan. 19, 2012

(51) Int. Cl.
*B41J 2/05* (2006.01)
*B41J 2/04* (2006.01)

(52) U.S. Cl. ..... 347/67; 347/54

(58) Field of Classification Search ..... None
See application file for complete search history.

(56) References Cited

U.S. PATENT DOCUMENTS

| | | | | |
|---|---|---|---|---|
| 4,164,745 | A | 8/1979 | Cielo et al. | |
| 4,514,741 | A | 4/1985 | Meyer | |
| 4,914,562 | A | 4/1990 | Abe et al. | |
| 5,485,186 | A * | 1/1996 | Ishinaga et al. | 347/65 |
| 6,332,668 | B1 * | 12/2001 | Ahn | 347/54 |
| 6,471,340 | B2 * | 10/2002 | Meyer | 347/65 |
| 6,854,830 | B2 | 2/2005 | Gue et al. | |
| 7,104,633 | B2 | 9/2006 | Kim et al. | |
| 7,207,661 | B2 | 4/2007 | Chou et al. | |
| 7,533,968 | B2 | 5/2009 | Silverbrook | |
| 7,533,970 | B2 | 5/2009 | Silverbrook | |
| 2003/0117461 | A1 | 6/2003 | Park et al. | |
| 2007/0279458 | A1 | 12/2007 | Lee et al. | |

FOREIGN PATENT DOCUMENTS

| | | |
|---|---|---|
| JP | 2005-193667 | 7/2005 |
| JP | 4236053 | 3/2009 |

* cited by examiner

*Primary Examiner* — Geoffrey Mruk
(74) *Attorney, Agent, or Firm* — Nathan R. Rieth

(57) ABSTRACT

An inkjet printhead includes a substrate having a recessed cavity formed therein. The cavity has a continuous sidewall around the perimeter of the cavity. The printhead includes a heating element formed onto the sidewall of the cavity.

8 Claims, 11 Drawing Sheets

THERMAL INKJET PRINTHEAD WITH HEATING ELEMENT IN RECESSED SUBSTRATE CAVITY

BACKGROUND

In a typical thermal bubble inkjet printing system, an inkjet printhead ejects ink droplets through a plurality of nozzles toward a print medium, such as a sheet of paper, to print an image onto the print medium. The nozzles are typically arranged in one or more arrays, such that properly sequenced ejection of ink from the nozzles causes characters or other images to be printed on the print medium as the printhead and the print medium are moved relative to each other.

Thermal inkjet printheads eject droplets of fluid from a nozzle by passing electrical current through a heating element to generate heat and vaporize a small portion of the fluid within a firing chamber. The current is supplied as a pulse which lasts on the order of 2 micro-seconds. When a current pulse is supplied, the heat generated by the heating element creates a rapidly expanding vapor bubble that forces a small droplet out of the firing chamber nozzle. When the heating element cools, the vapor bubble quickly collapses. The collapsing vapor bubble draws more fluid from a reservoir into the firing chamber in preparation for ejecting another drop from the nozzle. Unfortunately, because the ejection process is repeated thousands of times per second during printing, the collapsing vapor bubbles can also have the adverse effect of damaging the heating element. Collapse of the vapor bubble leads to cavitation damage to the heater surface material. Each of the millions of collapse events ablates the coating material. Once ink can penetrate the layer or surface material on the heating element and contact the hot, high voltage resistor surface, rapid corrosion and physical destruction of the resistor soon follows.

BRIEF DESCRIPTION OF THE DRAWINGS

The present embodiments will now be described, by way of example, with reference to the accompanying drawings, in which.

Throughout the drawings, identical reference numbers designate similar, but not necessarily identical, elements.

DETAILED DESCRIPTION

Overview of Problem and Solution

As noted above, cavitation damage to heating elements in thermal inkjet printheads will accumulate over time as the drop ejection process of expanding and collapsing vapor bubbles is repeated thousands of times each second during printing. Once cavitation has ablated the overcoat layer, the heater is destroyed and will not eject ink.

Figure 1:
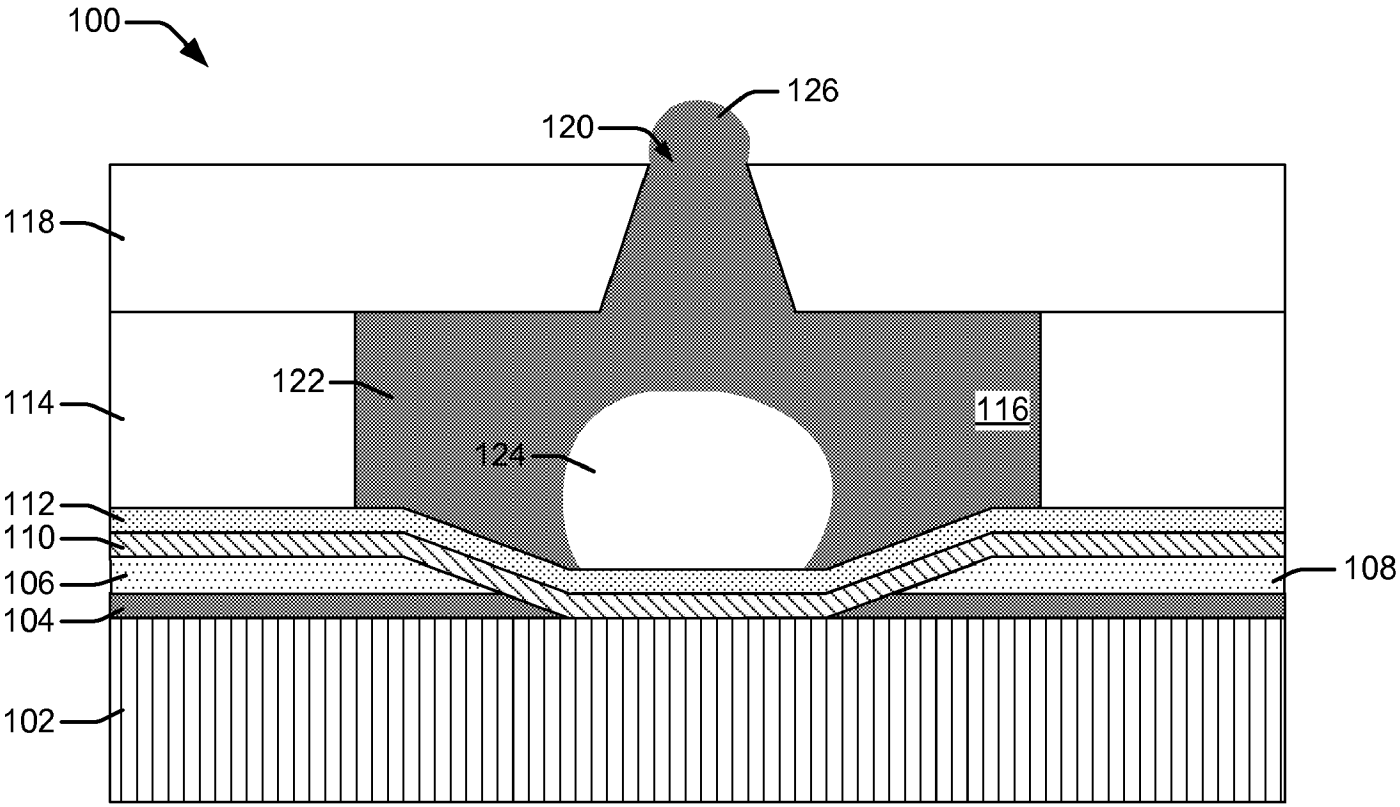
PRIOR ART FIG. 1
FIG. 1 shows a partial cross-sectional view of an example thermal inkjet printhead that employs an overcoat layer formed over the heating element according to the prior art.

A common technique used to reduce the problem of cavitation damage is to try and make the heating element more robust so that it can better withstand the shock waves from the collapsing vapor bubbles. FIG. 1 shows a partial cross-sectional view of an example conventional thermal inkjet printhead 100 that employs an overcoat layer formed over the heating element to provide additional structural stability and electrical isolation from the fluid in the firing chamber.

In the conventional thermal inkjet printhead 100 of FIG. 1, a substrate 102 is typically made of Si with a dielectric layer such as SiO2. A thin adhesion layer 104 on top of the substrate 102 increases the mechanical bonding strength of additional layers overlying the substrate 102. The adhesion layer 104 is typically a layer of titanium nitride (TiN). Aluminum electrodes (106, 108) are deposited over the adhesion layer 104 and may be shaped, for example, by dry ion etching to form beveled edges. The heating element 110 is a resistor layer of tungsten silicon nitride (WSiN), for example, deposited on the surface of substrate 102, including over the aluminum electrodes (106, 108). The heating element 110 may be deposited by conventional integrated circuit fabrication techniques such as sputtering a resistive material over the electrodes (106, 108). There are several types of materials that may be used to make the heating element 110, such as a tantalum aluminum alloy, for example. One or more additional overcoat layers 112 can be formed over the heating element 110 to provide additional structural stability and electrical insulation from fluid in the firing chamber. The heating element 110 is isolated from the ink with a dielectric material after which another material such as silicon nitride/silicon carbide and/or tantalum is added for strength to delay failure due to cavitation. In the example thermal inkjet printhead 100 of FIG. 1, overcoat layer 112 is intended to illustrate the addition of these overcoat materials to heating element 110.

A barrier layer/chamber layer 114 is formed onto the substrate 102 as a dry film laminated by heat and pressure, for example, or as a wet film applied by spin coating. The chamber layer 114 material is a photoimageable polymer such as SUB. Chamber(s) 116 are formed in the chamber layer 114 by common photoimaging techniques. A nozzle plate 118 includes nozzle orifice(s) 120 formed over respective chamber(s) 116 such that each chamber 116, associated nozzle 120, and associated heating element 110 are aligned. Thus, a chamber 116 includes chamber walls as its sides that are formed above the surface of substrate 102, a heater element 110 as its bottom formed on the surface of substrate 102, and a nozzle plate 118 and nozzle 120 formed over the chamber layer 114.

In the conventional thermal inkjet printhead 100 of FIG. 1, energizing the heating element 110 with an electrical current pulse heats the ink 122 in the chamber 116, causing an expanding vapor bubble 124 to eject a droplet 126 from the nozzle 120. When the electrical current pulse is turned off, the heating element 110 cools. The vapor bubble 124 collapses quickly and draws more fluid from a reservoir (not shown) into the firing chamber 116 in preparation for ejecting another drop from the nozzle 120. As mentioned above, this ejection process is repeated thousands of times per second during printing, and each time the vapor bubble 124 collapses it causes concentrated shock waves to impact the heating element 110. Thus, the heating element 110 experiences continuous high frequency shock waves during printing, which causes cavitation damage to accumulate over time. Once cavitation has ablated the overcoat layer, the heater element is destroyed and will not eject ink.

The additional overcoat layer 112 is designed to protect the heating element 110 from cavitation and other damage and increases the reliability of the heating element 110 by providing structural stability. Thicker overcoat layers 112 can further increase the reliability of the heating element 110. However, there are various disadvantages with this method of protecting the heating element 110 from cavitation damage. For example, the overcoat layer 112 acts as a heat sink that dissipates the heat generated by the heating element 110. Therefore, the overcoat layer 112 increases the amount of heat the heating element 110 must generate to fire droplets of ink through nozzle 120. Moreover, although a thicker overcoat layer 112 provides greater protection for the heating element 110, there is an undesirable corresponding increase in the heat sink affect of a thicker overcoat layer 112. In addition to the disadvantage of acting as a heat sink, a thick overcoat layer 112 also exhibits thermal hysteresis. That is, the temperature of the overcoat layer 112 lags behind the temperature of the heating element 110. The heating lag time can cause problems with ejection response time and with ink sticking to the surface of the overcoat layer 112 as it cools. These problems can reduce the amount of heat conducting from the heating element 110 and thereby degrade the ability of the printhead 100 to properly eject ink through nozzles 120.

Embodiments of the present disclosure overcome disadvantages such as those mentioned above by decoupling the effects of the collapsing vapor bubble from the heating element. The heating element is removed from the zone of impact of the collapsing vapor bubble so that the high frequency shock waves reduce cavitation damage to the heating element, which reduces the need for an overcoat layer to protect the heating element. Therefore, although an overcoat layer may be used, it's thickness can be reduced. A recessed cavity is formed within and below the surface of the printhead substrate, and the heating element is formed within the substrate along the walls of the recessed cavity. Because the heating element is not formed on the surface of substrate and does not make up the bottom of the firing chamber, it is not as involved in the degradation process caused by the repeated collapse of vapor bubbles.

In one embodiment, for example, an inkjet printhead includes a substrate with a recessed cavity formed in the substrate. The recessed cavity has a continuous sidewall around the perimeter of the cavity, and a heating element formed onto the sidewall of the cavity. The heating element covers the continuous sidewall around the perimeter of the cavity from the bottom of the cavity up the sidewall to a point between the bottom and top of the cavity, or up to the top of the cavity. In another embodiment, a method of fabricating an inkjet printhead includes forming a recessed cavity in a substrate. The cavity has a bottom and continuous sidewalls around an entire cavity perimeter. A heating element is formed on the sidewalls of the cavity. The recessed cavity is formed with an open top that is level with the surface of the substrate opposite to the bottom of the cavity. The heating element is formed with a length that covers the sidewalls around the entire cavity perimeter and a height that extends from the bottom of the cavity to a point between the bottom and the top of the cavity. In another embodiment, a method of ejecting a droplet from an inkjet printhead includes energizing a heating element formed within a recessed cavity of a substrate, where the recessed cavity has a sidewall with a continuous perimeter and the heating element covers the sidewall around the continuous perimeter of the recessed cavity.

ILLUSTRATIVE EMBODIMENTS

Figure 2A:
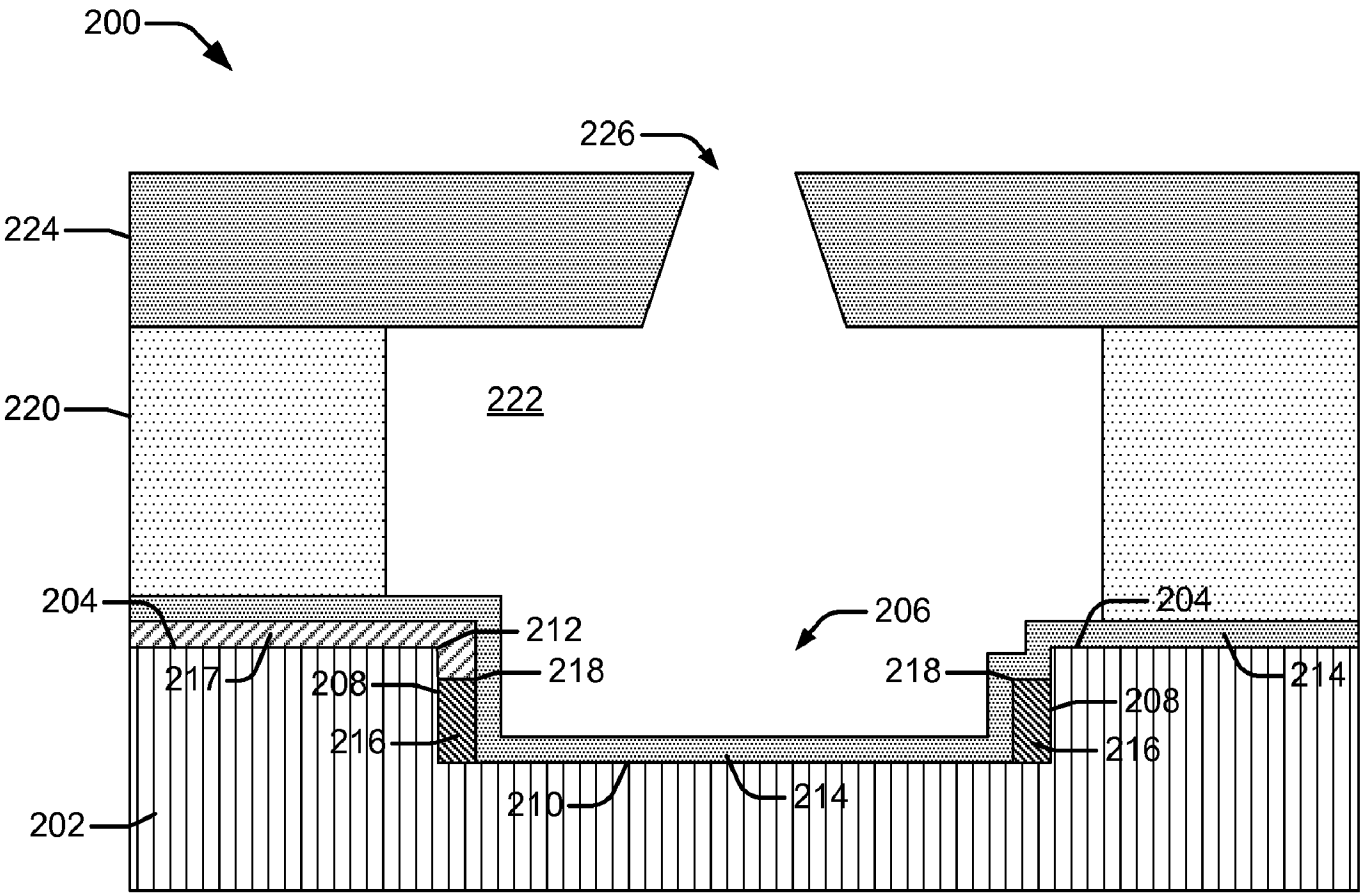
FIGS. 2A and 2B show a partial cross-sectional view of an example thermal inkjet printhead, according to embodiments.

FIG. 2 shows a partial cross-sectional view of an example thermal inkjet printhead 200, according to an embodiment. The printhead 200 includes a substrate 202 made, for example, of Si with a dielectric layer such as SiO2. Substrate 202 has a surface 204 on which various elements and layers may be formed that make up printhead 200. As will become apparent, such elements and/or layers may be formed in various orientations with respect to surface 204, such as on top of surface 204, within surface 204, below the surface 204, and so on. For example, a cavity 206 is formed in substrate 202. The cavity 206 is recessed within substrate 202 such that it may be considered to be under the surface 204 of the substrate 202. The recessed cavity 206 has a sidewall 208 or sidewalls (depending on the cavity shape) that extend around the entire perimeter of cavity 206. That is, the cavity has a continuous perimeter formed by a continuous cavity sidewall or sidewall (s) in which there is no break. The continuity of the sidewall (s) 208 of cavity 206 is better illustrated in FIGS. 3 and 4, where top down views of the example thermal inkjet printhead 200 are shown according to different embodiments.

Figure 3A:
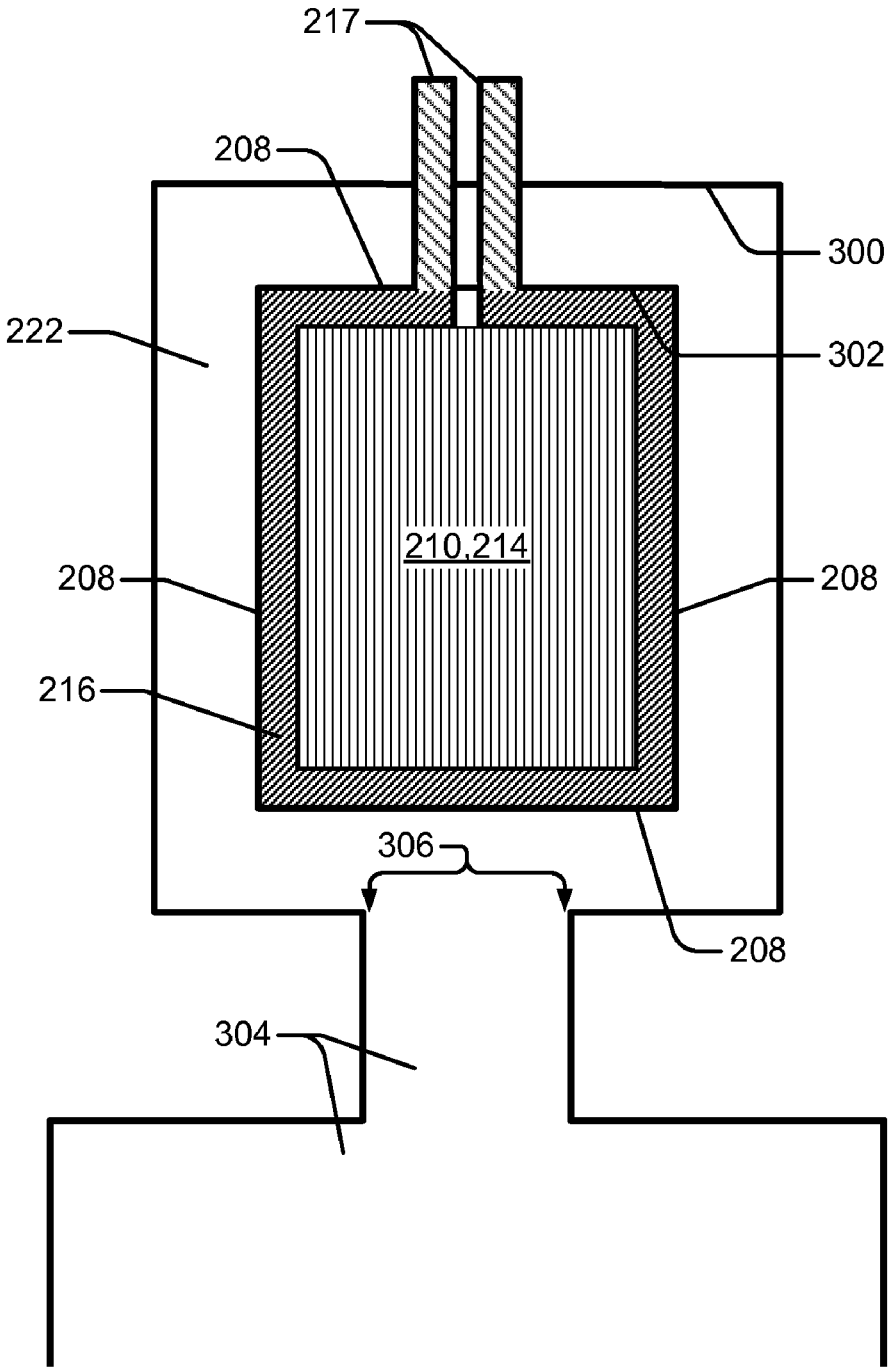
FIGS. 3A and 3B show a partial top-down view of an example thermal inkjet printhead with a rectangular shaped recessed cavity, according to embodiments.
Figure 3B:
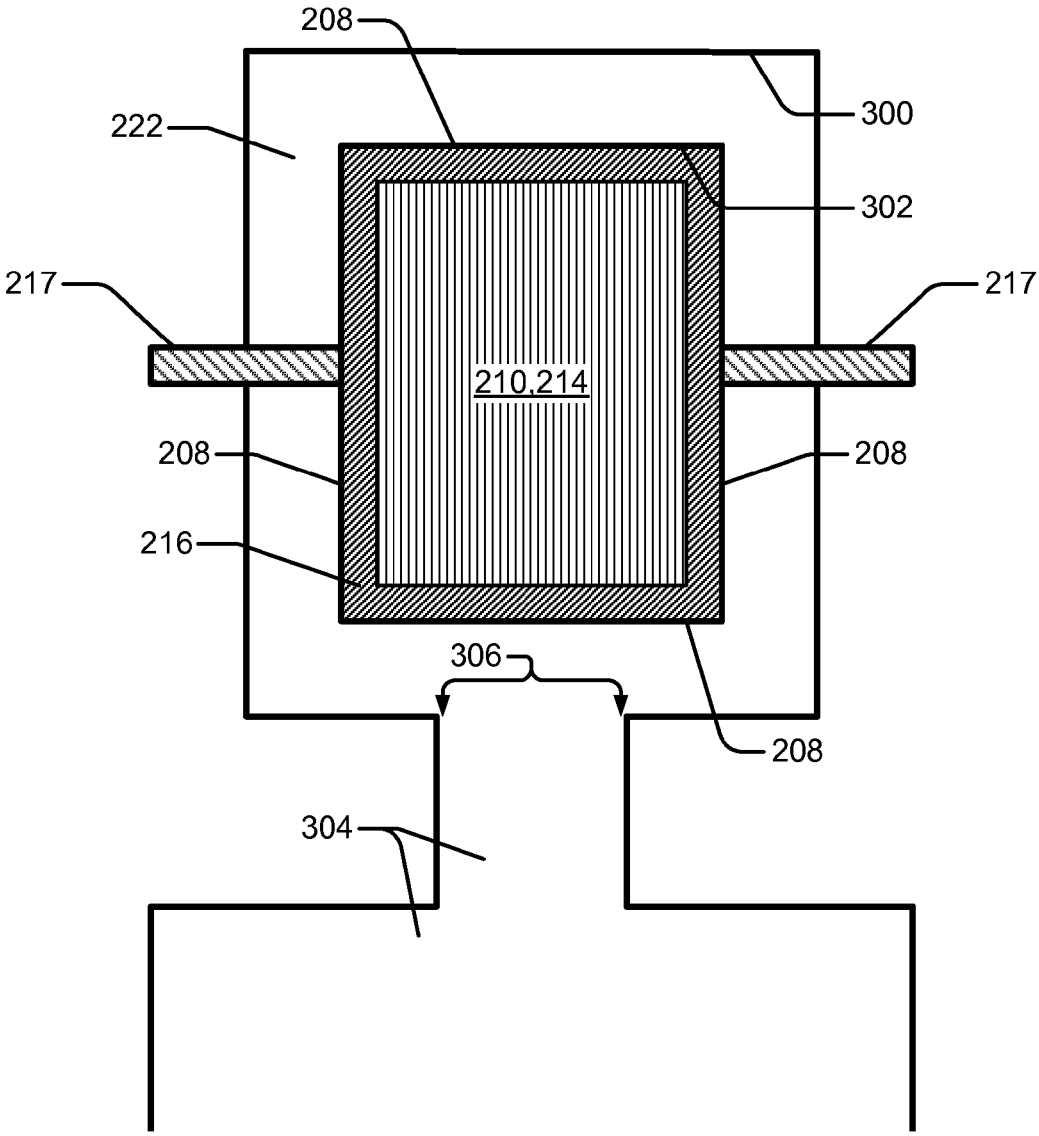
Figure 4A:
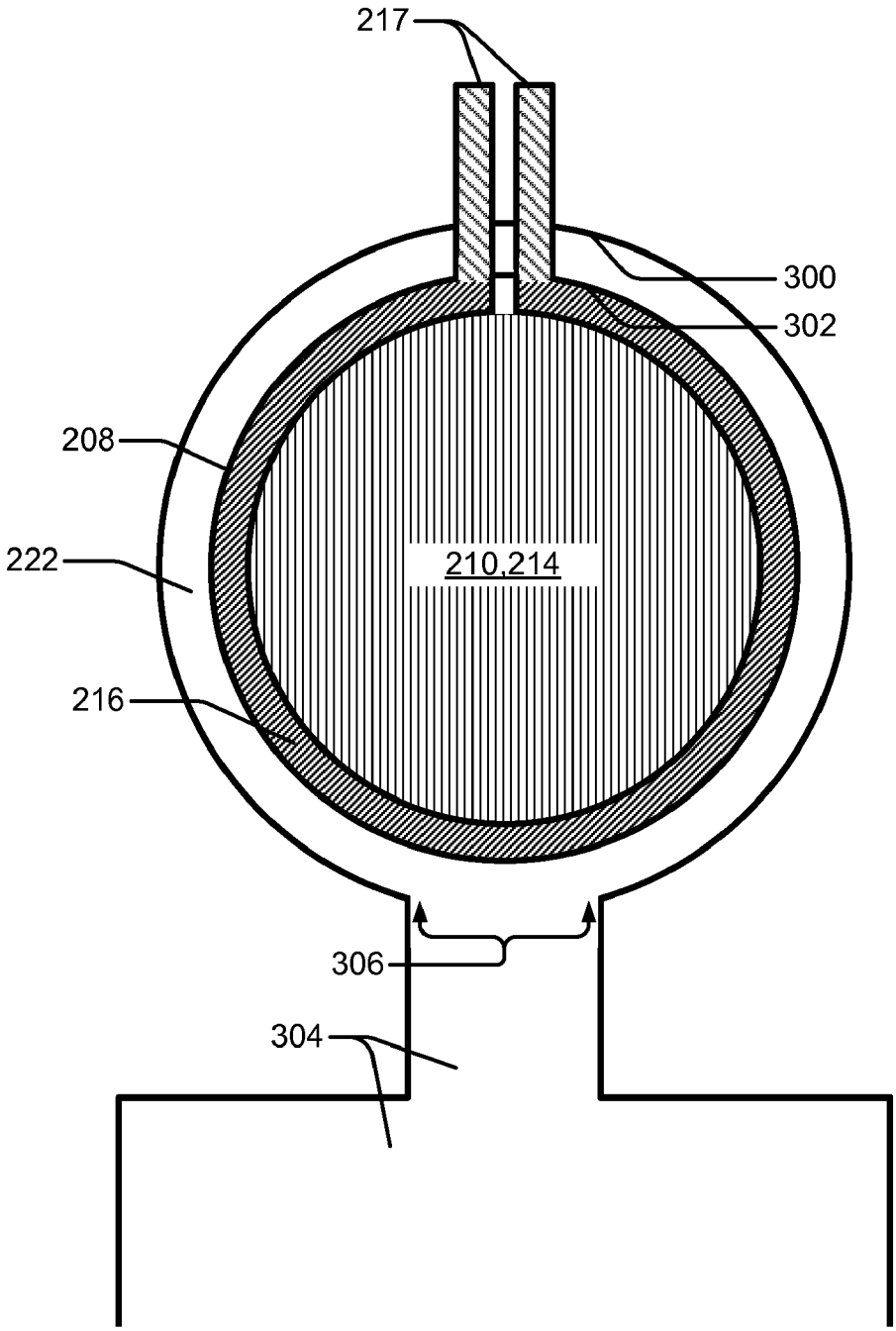
FIGS. 4A and 4B show a partial top-down view of an example thermal inkjet printhead with a circular or cylindrical shaped recessed cavity, according to embodiments.
Figure 4B:
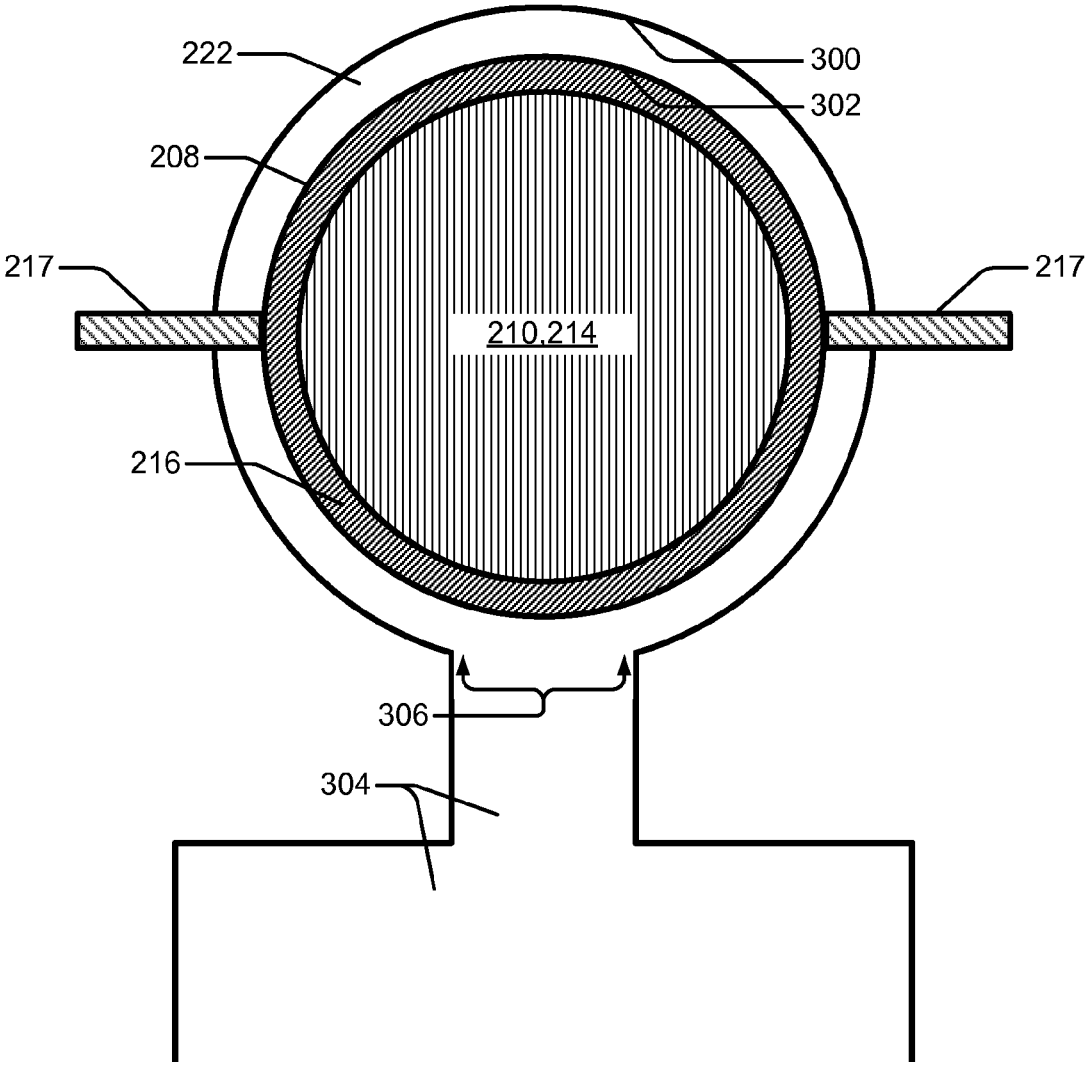

FIGS. 3A and 3B show a partial top-down view of an example thermal inkjet printhead 200 with a rectangular shaped recessed cavity 206, according to embodiments. FIGS. 4A and 4B show a partial top-down view of an example thermal inkjet printhead 200 with a circular or cylindrical shaped recessed cavity 206, according to embodiments. Although the recessed cavity 206 may be illustrated and discussed herein with respect to particular shapes and sizes, there is no intention that the shape and size of the cavity 206 are to be limited in this respect. Rather various shapes and sizes of cavity 206 are contemplated. Furthermore, it is to be understood that the size of the cavity 206 shown in relation to the printhead 200 is for purposes of illustration only, and is not intended to be a perfectly accurate or scaled representation.

Referring now to FIGS. 2, 3 and 4, the continuous nature of the sidewall(s) 208 around the perimeter of the recessed cavity 206 is apparent. In the FIG. 3 embodiments, because of the rectangular shape of the recessed cavity 206, it is apparent that the cavity 206 has more than one sidewall 208. Specifically, the rectangular shaped cavity 206 has four sidewalls 208. In the FIG. 4 embodiments, however, because of the circular or cylindrical shape of the recessed cavity 206, it is apparent that the cavity 206 has a single sidewall 208. In either case, the sidewall or sidewalls of the recessed cavity 206 are continuous around the continuous perimeter of the cavity 206.

Referring again to FIG. 2, the sidewall(s) 208 extend from the bottom 210 of recessed cavity 206 to the top 212 of the cavity 206. The top 212 of cavity 206 is open and is level with the surface 204 of substrate 202. The bottom 210 of cavity 206 is closed by substrate 202 and may be coated with an overcoat layer 214. The overcoat layer 214 may cover the entire substrate 202 as shown. The overcoat layer 214 may be formed over a heating element 216. The overcoat layer 214 may include a dielectric material to insulate the heating element 216 from fluid in the firing chamber 222. The overcoat layer 214 may also include a layer such as tantalum or silicon nitride/silicon carbide to provide structural integrity and help protect both the substrate 202 and heating element 216 from cavitation damage.

Formed onto the sidewall 208 of the recessed cavity 206 is the heating element 216. The heating element 216 is in a vertical orientation, rather than a flat orientation, with respect to the bottom 210 of the recessed cavity 206. Heating element 216 is a resistor layer made of tungsten silicon nitride (WSiN) or tantalum aluminum alloy, for example. As discussed above, the heating element 216 may have an overcoat layer 214 including a dielectric coating to prevent corrosion (e.g., electrical, chemical, mechanical). In addition, an overcoat layer 214 over the heating element 216 may include a protective coating such as Ta over the dielectric coating layer.

Figure 5:
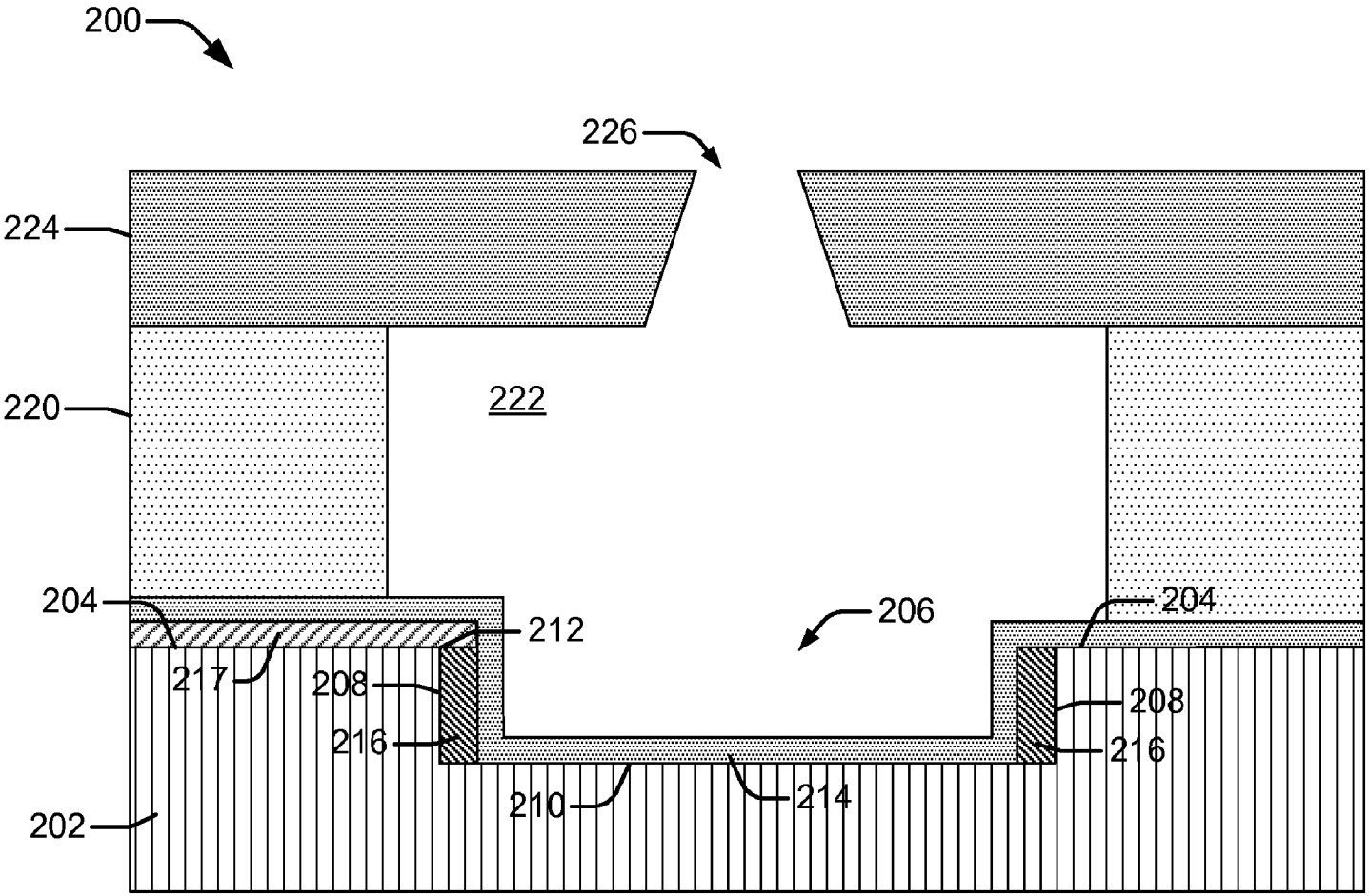
FIG. 5 shows a partial cross-sectional view of an example thermal inkjet printhead with a the heating element covering the continuous sidewall of the cavity, according to an embodiment.

The heating element 216 covers the sidewall 208 of cavity 206 around the entire and continuous perimeter of the cavity. However, in some embodiments the heating element 216 does not necessarily cover the entire sidewall 208. As shown in FIG. 2, for example, heating element 216 covers the continuous sidewall 208 of the cavity 206 from the bottom 210 of the cavity 206 to a point 218 that stops part way up the sidewall between the bottom 210 and top 212 of the cavity. However, in other embodiments, the heating element 216 may fully cover the continuous sidewall 208 of the cavity 206 from the bottom 210 of the cavity 206 to the top 212 of the cavity, as is shown by the example thermal inkjet printhead 200 of FIG. 5.

Where the heating element 216 extends from the bottom 210 of the cavity 206 to a point 218 part way up the sidewall 208 between the bottom 210 and top 212 of the cavity, as in the FIG. 2 embodiment, advantages may be realized in different heights of the heating element 216. A suitable height of the heating element 216 between the bottom 210 and point 218 up the sidewall 208 is, for example, approximately 5 micrometers. Furthermore, referring to the circular or cylindrical shaped cavity 206 of FIG. 4, a suitable radius of the cylinder is, for example, 17 micrometers. Accordingly, in some embodiments a suitable example of a surface area of the heating element 216 is approximately 530 square micrometers.

Referring to FIGS. 2-5, conductors 217 provide electrical conductivity to heating element 216. As shown in FIGS. 2A and 2B, conductors 217 may come over the top of sidewall 208. As shown in FIGS. 3A, 3B, 4A and 4B, conductors 217 may be formed in various locations and various configurations with respect to heating element 216. For example, in FIGS. 3A and 4A, both conductors 217 connect to heating element 216 at a location toward one side of the firing chamber 222. However, in FIGS. 3B and 4B, the conductors 217 connect to heating element 216 at locations opposite one another around the firing chamber 222. In addition, as shown in FIG. 2A, conductor 217 may be formed after the heating element 216, and may contact the heating element 216 in an area toward the top side of the heating element 216. Or, in another embodiment as shown in FIG. 2B, conductor 217 may be formed prior to forming the heating and may contact the heating element 216 in an area that is under or behind the heating element 216.

A chamber layer 220 is formed on the surface 204 of the substrate 202 having chambers such as chamber 222 formed over cavity 206. The formation of chamber layer 220 may be as a dry film laminated by heat and pressure, for example, or as a wet film applied by spin coating. The chamber layer 220 material is a photoimageable polymer such as SU8. Chambers such as chamber 222 are formed in the chamber layer 220 by common photoimaging techniques. A nozzle plate 224 includes nozzle orifices such as nozzle 226 formed over respective chambers such that each chamber 222, associated nozzle 226, and associated cavity 206 are aligned. As is apparent from FIGS. 2-4, the chamber perimeter 300 is bigger than the cavity perimeter 302. Conversely, the cavity perimeter 302 is smaller than the chamber perimeter 300. Furthermore, it is noteworthy that the chamber perimeter 300 is discontinuous, or broken, at the point where the ink channel 304 intersects the chamber 222. The discontinuity 306 of the chamber perimeter 300 at the ink channel 304 intersection is better illustrated in FIGS. 3 and 4. By contrast to the discontinuous chamber perimeter 300, the cavity perimeter 302 (sidewall 208) is continuous as the cavity 206 is recessed into the substrate 202.

Figure 6:
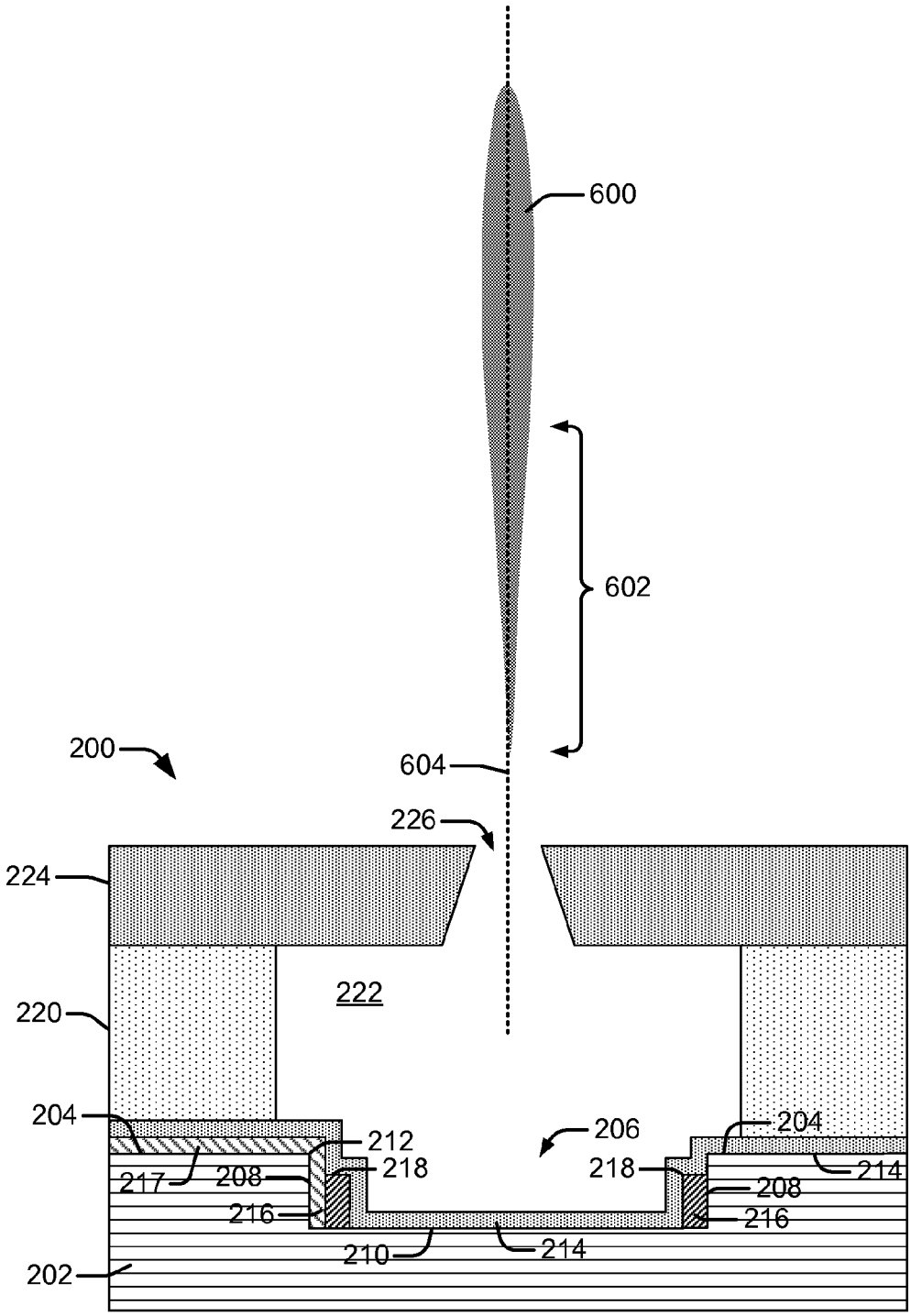
FIG. 6 shows an example of an ejected droplet from a thermal inkjet printhead having a drop tail substantially centered on the axis of the nozzle according to an embodiment.

As noted above, one advantage of the heating element 216 being formed vertically along the walls of the recessed cavity 206 within substrate 202, is the decoupling of the heating element 216 from the area of impact of the high frequency shock waves caused by collapsing vapor bubbles. Such decoupling reduces cavitation damage to the heating element 216 and reduces the need for a protective coating such as Ta over the heating element 216. Thus, although a protective overcoat layer 214 may be used, it's thickness is reduced. Another advantage is the uniform and symmetrical shape of the ejected ink droplet created by the vertical sidewall heating element 216 within the recessed cavity 206. For example, as shown in FIG. 6, in one embodiment where the cavity 206 is cylindrical and the area of the heating element 216 is approximately 530 square micrometers (as discussed above), an ejected droplet 600 has a drop tail 602 that is substantially centered on the axis 604 of the nozzle 216. The recessed cavity 206 and vertical heating element 216 produce highly controlled droplets with ideal symmetry.

Figure 7:
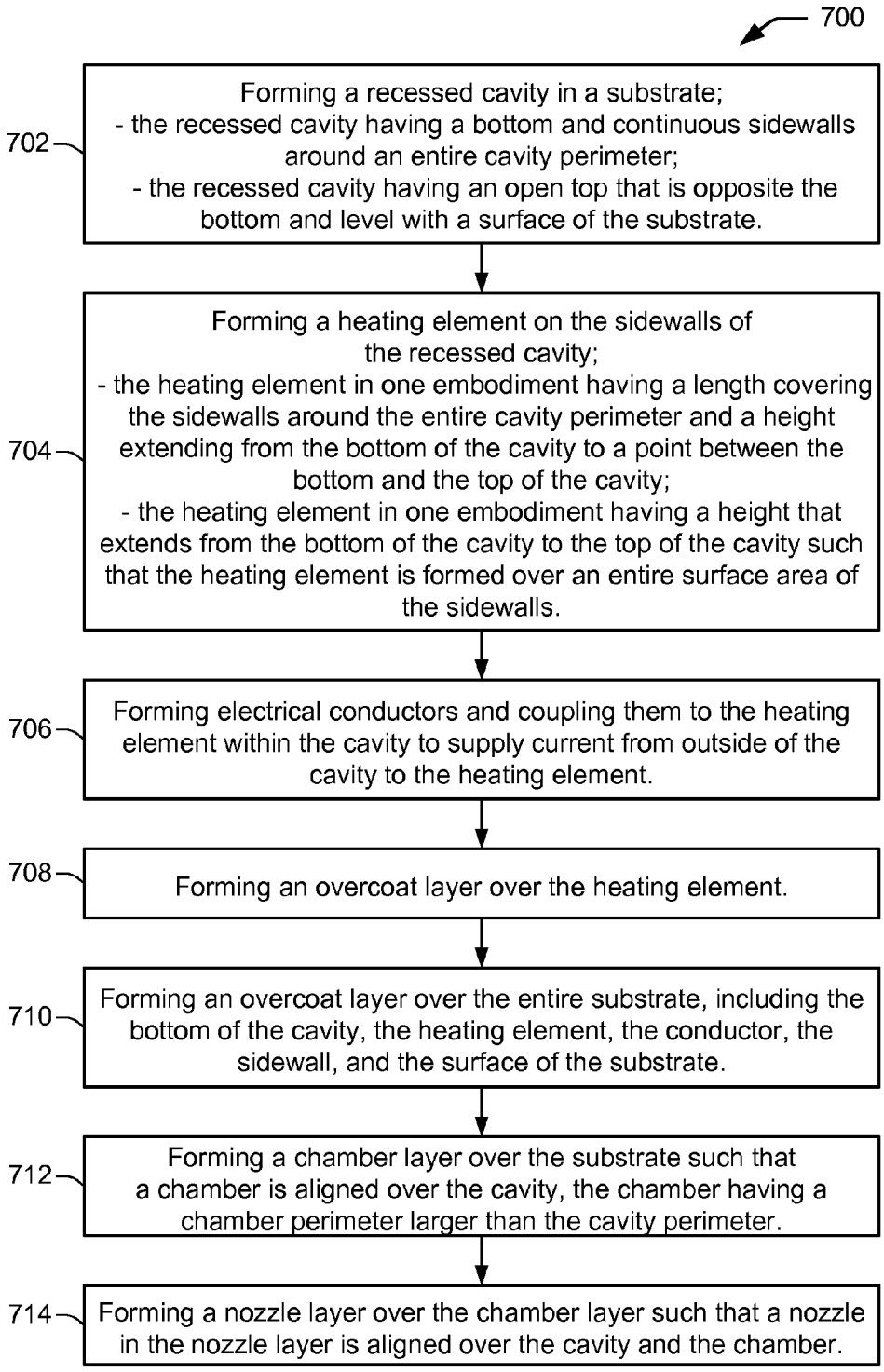
FIG. 7 shows a flowchart of an example method of fabricating a thermal inkjet printhead, according to an embodiment.

FIG. 7 shows a flowchart of an example method 700 of fabricating a thermal inkjet printhead, according to an embodiment. Method 700 is associated with the embodiments of a thermal inkjet printhead 200 discussed above with respect to illustrations in FIGS. 2-6. Although method 700 includes steps listed in certain order, it is to be understood that this does not limit the steps to being performed in this or any other particular order. In general, the steps of method 700 may be performed using various precision microfabrication techniques such as electroforming, laser ablation, anisotropic etching, sputtering, dry etch, and photolithography, as are well-known to those skilled in the art.

Method 700 begins at block 702 with forming a recessed cavity in a substrate, such as a silicon substrate. The recessed cavity has a bottom that is closed by the substrate and a top that is opposite to the bottom and open at the surface of the substrate. The top of the cavity opens into a chamber (i.e., an ink chamber). The cavity has continuous sidewalls that extend around the entire perimeter of the cavity.

At block 704 of method 700, a heating element is formed on the sidewalls of the cavity in a vertical orientation with respect to the bottom of the cavity. The heating element typically has a dielectric coating to insulate it and prevent corrosion (e.g., chemical, mechanical, electrical), and there may also be a protective coating such as Ta over the dielectric coating layer. In one embodiment the heating element has a length covering the sidewalls around the entire cavity perimeter and a height extending from the bottom of the cavity to a point between the bottom and the top of the cavity. In another embodiment the heating element has a height that extends from the bottom of the cavity to the top of the cavity such that the heating element is formed over the entire surface area of the sidewalls.

Figure 2B:
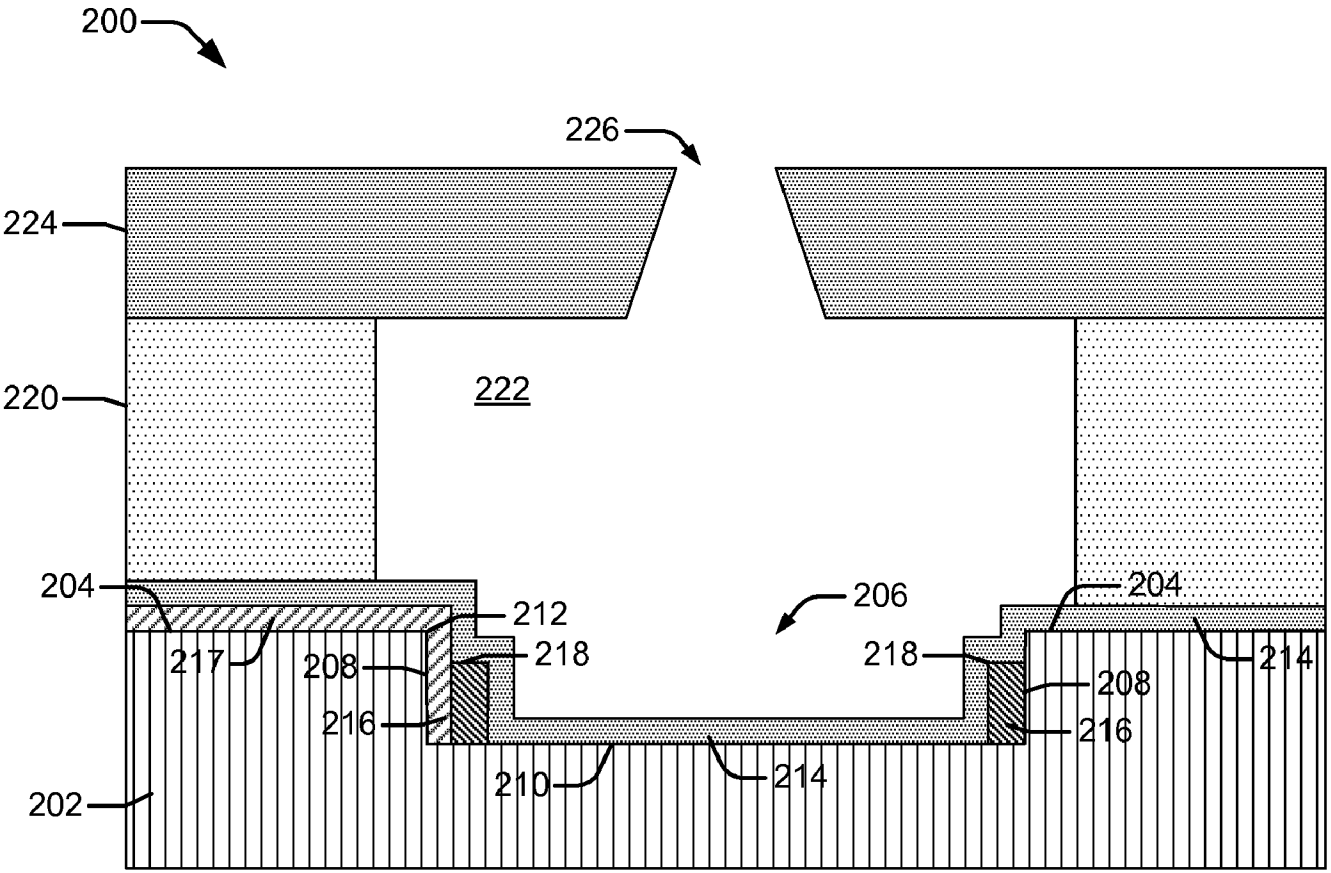

At block 706 of method 700, electrical conductors are formed and coupled to the heating element within the cavity to supply current from outside of the cavity to the heating element. As noted above, conductors may come over the top of the sidewall and may be formed in various configurations and locations with respect to the heating element. For example, conductors may connect to the heating element at a location toward one side of the firing chamber, or they may connect to the heating element at locations opposite one another around the firing chamber. In addition, a conductor may be formed after the heating element is formed, and it may contact the heating element in an area toward the top side of the heating element as in FIG. 2A. Or, in another embodiment as shown in FIG. 2B, a conductor may be formed prior to forming the heating and may contact the heating element in an area that is under or behind the heating element.

At block 708 an overcoat layer is formed over the heating element. The overcoat layer includes a dielectric material to insulate the heating element from fluid in the firing chamber. The overcoat layer may also include a layer such as tantalum to provide structural integrity and to help protect the heating element from damage. At block 710, an overcoat layer may be formed over the entire substrate, including the bottom of the cavity, the heating element, the conductor, the sidewall, and the surface of the substrate. An overcoat layer over the entire substrate may be covered with tantalum to help protect both the substrate 202 and heating element 216 from cavitation damage.

At block 712 of method 700, a chamber layer is formed over the substrate such that a chamber is aligned over the cavity. The chamber has a chamber perimeter that is larger than the cavity perimeter.

At block 714 of method 700, a nozzle layer is formed over the chamber layer such that a nozzle in the nozzle layer is aligned over the recessed cavity and the chamber.

Figure 8:
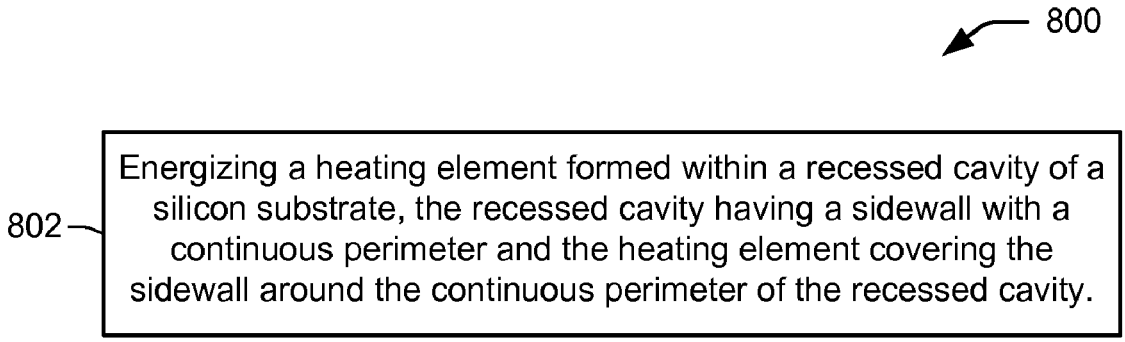
FIG. 8 shows a flowchart of an example method of ejecting a droplet from an inkjet printhead, according to an embodiment.

FIG. 8 shows a flowchart of an example method 800 of ejecting a droplet from an inkjet printhead, according to an embodiment. Method 800 is associated with the embodiments of a thermal inkjet printhead 200 discussed above with respect to illustrations in FIGS. 2-6. Method 800 comprises energizing a heating element formed within a recessed cavity of a silicon substrate as shown at block 802. The recessed cavity has a sidewall with a continuous perimeter and the heating element covers the sidewall around the continuous perimeter of the recessed cavity.

What is claimed is:

1. An inkjet printhead comprising:

a silicon substrate having a surface;

a cavity formed in the substrate, the cavity having an open top at the substrate surface, a closed bottom recessed into the substrate, and a continuous sidewall that extends vertically between the top and the bottom around a perimeter of the cavity; and a heating element formed onto the sidewall of the cavity.

2. An inkjet printhead as in claim 1, wherein the heating element covers the continuous sidewall from the bottom of the cavity to a point part way between the bottom and top of the cavity.

3. An inkjet printhead as in claim 2, wherein the heating element has a height of about 5 micrometers from the bottom of the cavity to the point part way between the bottom and top of the cavity.

4. An inkjet printhead as in claim 1, further comprising:

an ink chamber formed on the substrate and aligned over the cavity; and a nozzle plate formed over the ink chamber having a nozzle aligned over the cavity through which ink drops are ejected.

5. An inkjet printhead as in claim 4, wherein the cavity and ink chamber are cylindrical, and wherein the perimeter of the cavity is smaller than a perimeter of the ink chamber.

6. An inkjet printhead as in claim 1, further comprising a conductor disposed parallel to the substrate surface and extending into the cavity from the top, the conductor terminating at the heating element such that it does not extend to the bottom of the cavity.

7. An inkjet printhead as in claim 1, wherein the cavity is cylindrical.

8. An inkjet printhead as in claim 1, wherein the heating element has a length of about 106.8 micrometers extending around the entire cavity perimeter.

* * * * *